US010544613B2

(12) United States Patent
Tsui et al.

(10) Patent No.: US 10,544,613 B2
(45) Date of Patent: Jan. 28, 2020

(54) SECURITY-ENHANCED GARAGE DOOR OPENER SYSTEM

(71) Applicants: Philip Yu Wing Tsui, Hong Kong (HK); Gallen Ka Leung Tsui, Brampton (CA)

(72) Inventors: Philip Yu Wing Tsui, Hong Kong (HK); Gallen Ka Leung Tsui, Brampton (CA)

( * ) Notice: Subject to any disclaimer, the term of this patent is extended or adjusted under 35 U.S.C. 154(b) by 57 days.

(21) Appl. No.: 15/892,860

(22) Filed: Feb. 9, 2018

(65) Prior Publication Data

US 2018/0223580 A1 Aug. 9, 2018

Related U.S. Application Data

(60) Provisional application No. 62/456,792, filed on Feb. 9, 2017.

(51) Int. Cl.
*E05F 15/00* (2015.01)
*E05F 5/00* (2017.01)
*E05F 15/684* (2015.01)

(52) U.S. Cl.
CPC ..... *E05F 5/003* (2013.01); *E05F 15/684* (2015.01); *E05Y 2201/214* (2013.01); *E05Y 2201/656* (2013.01); *E05Y 2900/106* (2013.01)

(58) Field of Classification Search
CPC ..... E05F 5/003; E05F 15/681; E05F 15/684; E05Y 2201/244; E05Y 2201/214; E05Y 2201/656; E05Y 2900/106
USPC ..... 49/197, 199, 139
See application file for complete search history.

(56) References Cited

U.S. PATENT DOCUMENTS 3,235,246 A * 2/1966 Cowan ..... E05F 15/684 49/139
3,858,452 A * 1/1975 Gatland ..... F16H 25/2025 74/424.78
3,909,980 A * 10/1975 Courtney ..... E05F 15/681 49/139
4,155,268 A * 5/1979 Lee ..... F16H 25/2025 74/424.78
4,155,269 A * 5/1979 Lee ..... F16H 25/2025 74/424.78
4,905,542 A * 3/1990 Burm ..... E05F 15/668 104/120
4,996,795 A * 3/1991 Niswonger ..... E05B 65/0021 160/188
5,544,924 A * 8/1996 Paster ..... E05B 15/0006 160/201

(Continued)

*Primary Examiner* — Jerry E Redman

(57) ABSTRACT

This invention is about an improved garage door opener system, with design features for preventing garage door break-in from outside of the garage using an object such as a hanger. Typically, a person pulls down a cord connected to a release handle to release emergency release of a garage door opener, allowing the door to be manually open or closed. An unauthorized person may attempt to pull down the cord using a hanger from outside the garage or to pull or push down the release handle, to open the door from outside and gain unauthorized entrance. The improved garage door opener system provides a mechanism to reverse the pulling direction of the cord and also protects release handle from being accessed from outside the garage, for increased security.

20 Claims, 8 Drawing Sheets

(56) References Cited

U.S. PATENT DOCUMENTS

| | | | | |
|---|---|---|---|---|
| 6,273,174 | B1 * | 8/2001 | Singleton | E05F 15/681 160/188 |
| 6,434,886 | B1 * | 8/2002 | Johnson | E05D 15/165 160/205 |
| 6,557,301 | B1 * | 5/2003 | Hormann | E05B 65/0021 49/139 |
| 7,591,102 | B1 * | 9/2009 | Evans | E05F 15/668 49/7 |
| 8,936,064 | B1 * | 1/2015 | Diaz | E05F 15/681 160/201 |
| 2002/0088682 | A1 * | 7/2002 | Chang | E05B 65/0021 192/30 R |
| 2002/0178668 | A1 * | 12/2002 | Haab | E05D 13/04 52/243.1 |
| 2003/0208961 | A1 * | 11/2003 | Griffin | E05F 15/668 49/141 |
| 2004/0055219 | A1 * | 3/2004 | Chen | E05F 15/681 49/139 |
| 2005/0120629 | A1 * | 6/2005 | Chang | E05F 15/668 49/197 |
| 2007/0068081 | A1 * | 3/2007 | Hoermann | E05F 15/668 49/197 |
| 2015/0337580 | A1 * | 11/2015 | Nykilchuk | E05D 13/1261 49/197 |

* cited by examiner

SECURITY-ENHANCED GARAGE DOOR OPENER SYSTEM

FIELD OF INVENTION

The invention relates generally to the field of garage door openers. In particular, the invention relates to an improved garage door opener system, with design features for preventing garage door break-in by opening the door from outside of the garage.

BACKGROUND OF INVENTION

A garage door opener connects a garage door, such as a sectional, roll-up door, to a motor drive system. Energizing a motor of the motor drive system moves up or down the door, thus opens or closes the door. The motor is generally controlled remotely, which may be by a hand-held or other portable device or controlled through a wall-mounted control panel, among others. A door generally cannot be forced to move against the motor drive system, whether to open or close the door.

However, for safety or emergency, such as due to power failure or malfunctioning of the garage door opener, it is desirable and often required by industry standard to allow manual opening or closing of the door. An emergency release mechanism is provided for this purpose. The emergency release mechanism allows a person to disengage the door from the motor drive system, thus allowing the manual opening or closing of the door. When there is power outage or malfunction of a garage door opener, a person can use the emergency release to disengage the garage door from the motor drive system, and then open or close the door manually during emergency.

However, this could create a security threat to home owners. The emergency release usually involves a lever having a cord connected thereto, pulling down on this cord would disengage the door from the motor drive system and the door would be able to move freely. For a determined theft, it is not difficult to reach this release cord or lever from outside the garage door using a thin and long object, such as a hanger, inserted through a gap between the garage door and its frame, and then by grabbing the cord (or simply grabbing the lever) and pulling down the hanger to disengage the emergency release. The door then can be opened from the outside.

To address this safety concern, there are aftermarket safety devices available on the market that would prevent theft from opening a garage door from the outside. Examples of such devices include electronics door locks, which works like a deadbolt for the garage door opener. But this can be expensive and difficult to install.

It is therefore desirable to have a garage door opener that includes an anti-theft feature as part of the garage door opener, without any add-on device. It is an object of the present invention to mitigate or obviate at least one of the above mentioned disadvantages.

SUMMARY OF INVENTION

The present invention is directed to a safety feature that is built into a garage door opener system that could prevent one from opening the door from the outside by activating the emergency release. A broad aspect of the present invention involves an emergency release that cannot be disengaged by simply pulling down a cord by reversing the pulling direction of the cord. It also includes protective shields that prevent access to emergency release lever from outside the garage.

In one aspect of the invention, there is provided a garage door opener system that comprises a motor unit providing a driving force for moving a garage door; and a power transmission arrangement for transmitting the driving force from the motor unit to the garage door. The power transmission arrangement includes an emergency release unit. When the emergency release unit is engaged, the power transmission mechanism transmits the driving force from the motor to the garage door and when the emergency release unit is disengaged, the driving force is separated from the garage door. The emergency release unit comprises a body; a release actuator mounted to the body, the release actuator having a distal end for fastening a release cord thereto, wherein the emergency release unit changes from engaged to disengaged when the distal end travels along a disengaging direction a minimum amount of travel; a direction reverser positioned adjacent the distal end, the direction reverser supporting a section of the release cord around the direction reverser, wherein the direction reverser is positioned such that pulling the release cord suspended around the direction reverser does not move the distal end sufficiently along the disengagement direction to disengage the emergency release unit; and a biasing element secured to the body for suspending the section of the release cord around the direction reverser.

As one feature, the emergency release unit further comprises a blocking shield mounted to the body to deny access to the release actuator for disengaging the emergency release. Furthermore, the release actuator may be a release handle movably mounted to the body, and moving the distal end downward disengages the emergency release unit, and wherein the release handle has an upper edge and the blocking shield has a bottom edge, the upper edge of the release handle and the bottom edge of the blocking shield having complementary shapes to favor tight contact therebetween. Additionally, the blocking shield may comprise a flange formed on and extending from a side of the blocking shield, to cover the upper edge of the release handle.

As another feature, the power transmission arrangement further comprises a drive system coupled to and driven by the motor unit; a door arm to be connected to the garage door and, when engaged to and moved by the drive system, moving the garage door to open or close the garage door. The emergency release unit may further comprise a pair of cooperating engagement elements to releasably engage the door arm to the drive system.

As yet another feature, the release actuator is a release handle movably mounted to the body, the release handle having a distal end remote from the pivot point, wherein the release handle disengages the door arm when the distal end travels a minimum travel distance. As a further feature, the direction reverser is integrally formed with and extending from the release handle. Additionally, the direction reverser may be curved upwards towards its terminating tip or outer edge.

As a different feature, the release handle is pivotably mounted to the body at a pivot point and the direction reverser is positioned higher than the pivot point or is above the pivot point.

As yet another feature, the emergency release unit further comprises a protective wall that is sized to cover the distal end of the release actuator when the garage door is in a closed position. The protective wall may be sized to completely cover a fraction of the release handle near the distal end and the fraction may be one half, one third, one quarter, or one fifth.

In another aspect of the invention, there is provided a garage door opener system that comprises a motor unit providing a driving force for moving a garage door; and a power transmission arrangement for transmitting the driving force from the motor unit to the garage door. The power transmission arrangement includes an emergency release unit. When the emergency release unit is engaged, the power transmission mechanism transmits the driving force from the motor to the garage door and when the emergency release unit is disengaged, the driving force is separated from the garage door. The emergency release unit comprises a body; a release actuator mounted to the body, wherein moving a distal end of the release actuator along a disengage direction disengages the emergency release; and a blocking shield mounted to the body to deny access to the release actuator for forcing the distal end to move along the disengage direction to disengage the emergency release.

As a feature of this aspect of the invention, the emergency release unit further comprises a protective wall that is sized to cover the distal end of the release actuator when the garage door is in a closed position.

In other aspects the invention provides various combinations and subsets of the aspects described above.

BRIEF DESCRIPTION OF DRAWINGS

For the purposes of description, but not of limitation, the foregoing and other aspects of the invention are explained in greater detail with reference to the accompanying drawings, in which.

DETAILED DESCRIPTION OF EMBODIMENTS

Figure 1:
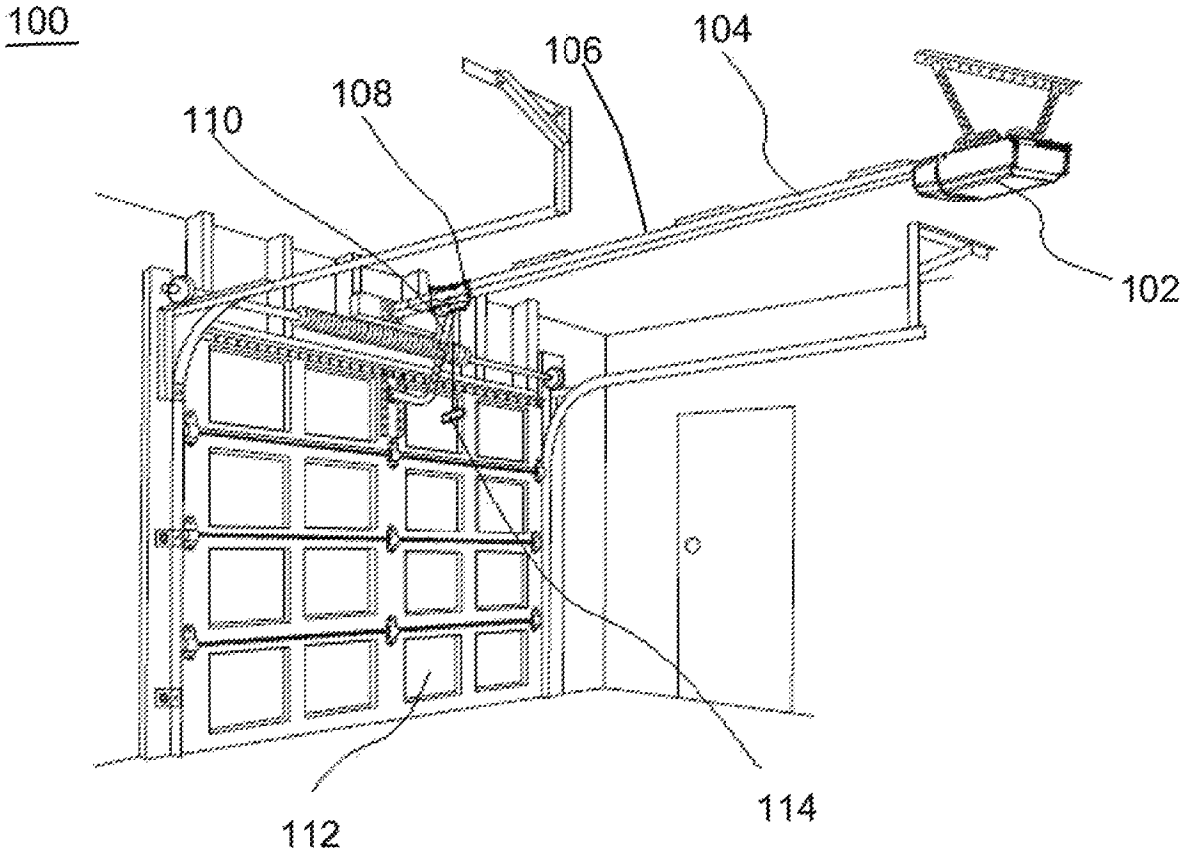
FIG. 1 in a schematic diagram illustrates a general setup of garage door opener with an emergency release.

The description which follows and the embodiments described therein are provided by way of illustration of an example, or examples, of particular embodiments of the principles of the present invention. These examples are provided for the purposes of explanation, and not limitation, of those principles and of the invention. In the description which follows, like parts are marked throughout the specification and the drawings with the same respective reference numerals.

This invention is about a more secure garage door opener system, mainly for reducing the risk of garage door break-in from outside of the garage. Some known risks of this type include using an object such as a hanger to activate the emergency release of a garage door opener, therefore, allowing the door to be opened from outside.

A garage door opener system includes features to prevent opening the door from outside by disengaging the emergency release is described. The garage door opener system includes an emergency release that cannot be disengaged by simply pulling down a cord due to the pulling direction of the cord being reversed or changed by a cord direction reverser of the emergency release. It also includes protecting shields that prevent access to emergency release lever from outside the garage.

FIG. 1 shows a general setup 100 of garage door opener system with an emergency release. A garage door opener motor unit 102 is mounted on the ceiling of a garage. Driving force provided by the motor unit 102 is transmitted to the door through a power transmission arrangement, which includes a drive system 104. FIG. 1 shows a drive system 104 having a rail 106, with either a chain or a belt (not shown in FIG. 1 but see FIG. 2) for driving a trolley 108, movably mounted on rail 106. The power transmission arrangement includes a door arm 110 that is connected to the garage door 112 and moved by the trolley 108. To open the door 112, the motor would turn in one direction to move the chain or belt, which in turn moves the trolley 108 towards the door opener motor unit 102 (i.e., away from the door 112), and therefore pulling up the door 112 towards the open direction. To close the door, the motor would turn in the opposite direction in order to push the door 112 downward towards the close direction. Although a trolley driven by chain or belt is shown in FIG. 1, it will be appreciated that the drive system 104 may use any other suitable power transmission, such as driver and driven gears, rack and pinion, among others.

The power transmission arrangement includes an emergency release unit. A release actuator in the nature of a release handle (not shown in FIG. 1, but see FIG. 3A or FIG. 5, for example), having a release cord 114 connected thereon, allows a person to pull down the release handle, thus disengage the trolley from the chain or belt. Here, downwards being a down-pointing direction when the garage door opener system is in an installed position. Once disengaged, trolley 108 can move freely along rail 106 and, the door can be moved manually, to open or close, without being hindered by the drive system.

Figure 2A:
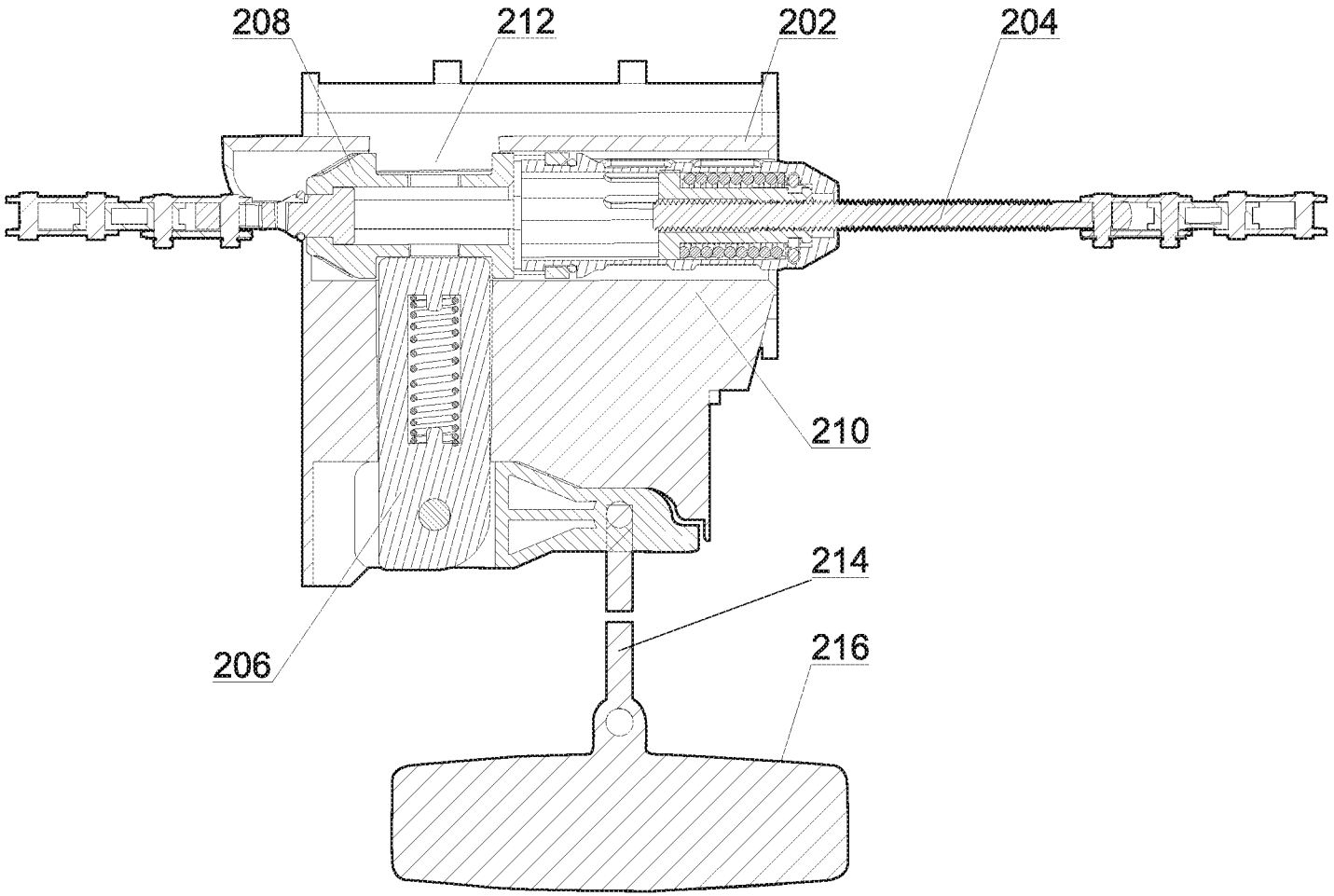
FIG. 2A is a cross-sectional view of an emergency release unit.

FIG. 2A is a cross-sectional view that shows an engagement mechanism 200. The engagement mechanism may be a standalone engagement unit, or may be incorporated into the drive system. The engagement mechanism has two (or more if desired) cooperating engagement elements. FIG. 2A shows a trolley 202 that can be releasably engaged to the drive system, such as the chain or belt 204, through a latch or plunger 206 that engages a carrier 208 fixedly mounted to the belt. The latch or plunger 206 is slideably mounted to the body 210 of the trolley 202 and inserted inwards to engage a grove 212 of the carrier 208, thus to engage the trolley 202 to the carrier 208. The carrier 208 is driven by the drive system 104, such as by a chain or a belt 204. Under normal operation condition, when engaged, the trolley 202 moves along the rail with the carrier 208 when the motor is energized but moves only when the motor is energized. The motor, and therefore the drive system, also acts as a door lock because the door cannot be opened manually either from the inside or outside against the drive system. To open the door manually, one would pull the emergency release cord 214 downwards, which is attached to the emergency release handle 216. Pulling down the cord pulls down both the release handle 216 and plunger 206. Here, the downwards direction is a disengagement direction, because pulling along this direction, i.e., pulling down the cord, pulls the plunger 206 out of the grove 212 of the carrier 208. This disconnects the trolley from the carrier. This disengages the trolley, and as a result, the door arm 110, from the drive system 104 and therefore separates the driving force of the motor from the garage door. Once disengaged, the door can move freely from the drive system.

Figure 2B:
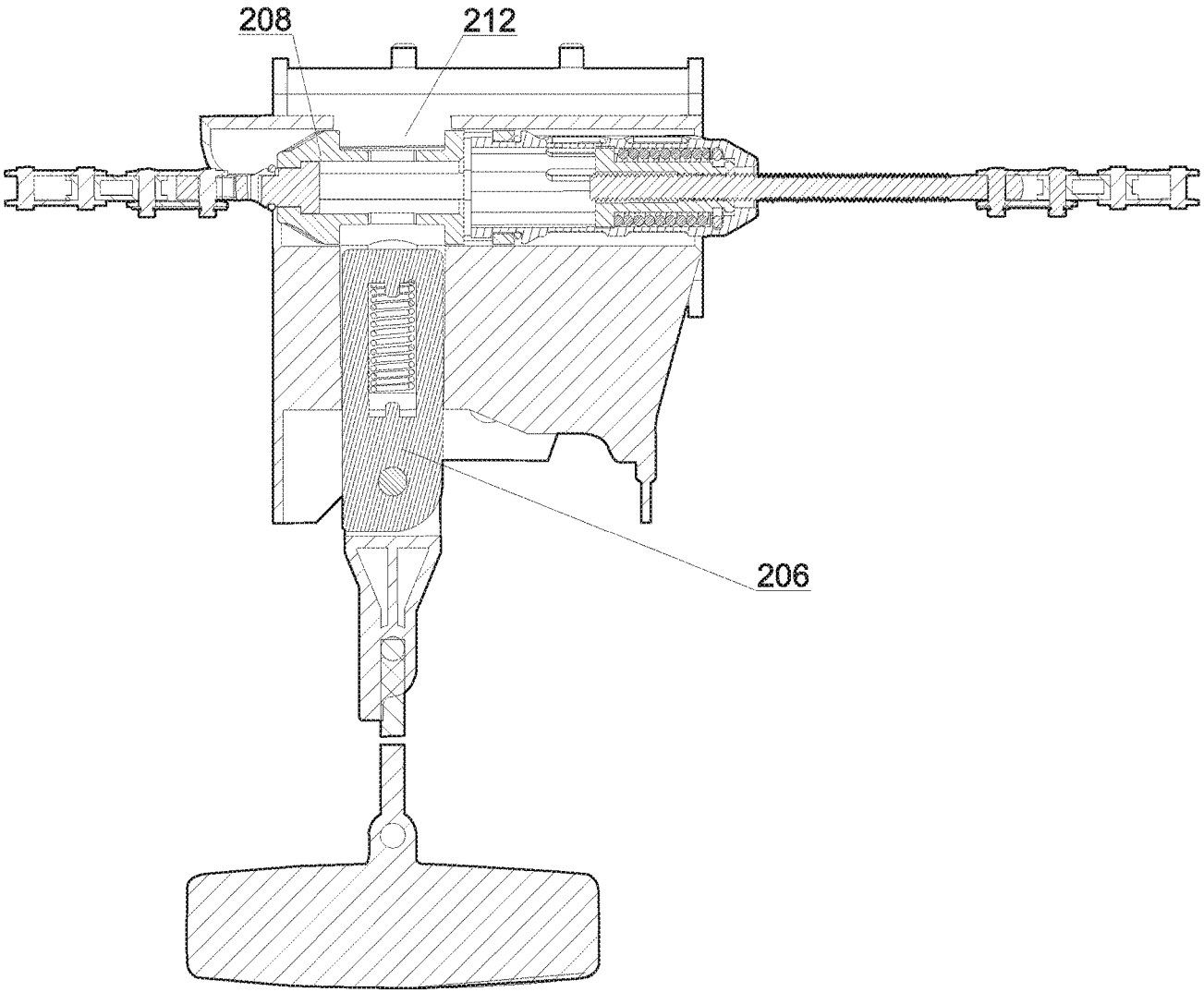
FIG. 2B is another cross-sectional view of shows the emergency release unit of FIG. 2A, illustrated in a disengaged state, a perspective view of which is illustrated in FIG. 4B, and the cross-sectional view is taken along the cutline 2B-2B in FIG. 4B.

FIG. 2B shows the position of the latch or plunger 206 when the trolley 202 is disengaged from the carrier 208. To engage the trolley 202 back to the drive system 104, one needs to pull the cord 302 up and towards the garage door opener motor unit to pull up the release handle 216 so as to position the plunger 206 in the grove 212 again, as shown in FIG. 2A. As will be appreciated, although FIG. 2B shows the release handle to have been rotated about 90° to disengage the trolley, i.e., from about horizontal to about vertical, in general, it is only necessary to pull the plunger 206 out of the grove 212. In other words, the handle may only need to be turned a degree less than 90°, such as 45°, or 60°, or some other minimum rotation angle that is sufficient to pull the plunger our of the grove.

As will be appreciated, although a plunger 206 and a cooperating grove 212 are described as the cooperating engagement elements, any suitable arrangements, such as clutches, also may be used in an engagement unit or for an engagement mechanism. What is required is that when the engagement elements are engaged, power from the motor unit is transmitted to the door arm 110. When the engagement elements are disengaged, i.e., when the engagement is released, the motor unit is decoupled to the door arm 110, and therefore the door can be manually opened. In other words, in the disengaged state, the driving force from the motor unit is separated from the door, thus leaving the door to be freely movable.

Figure 3A:
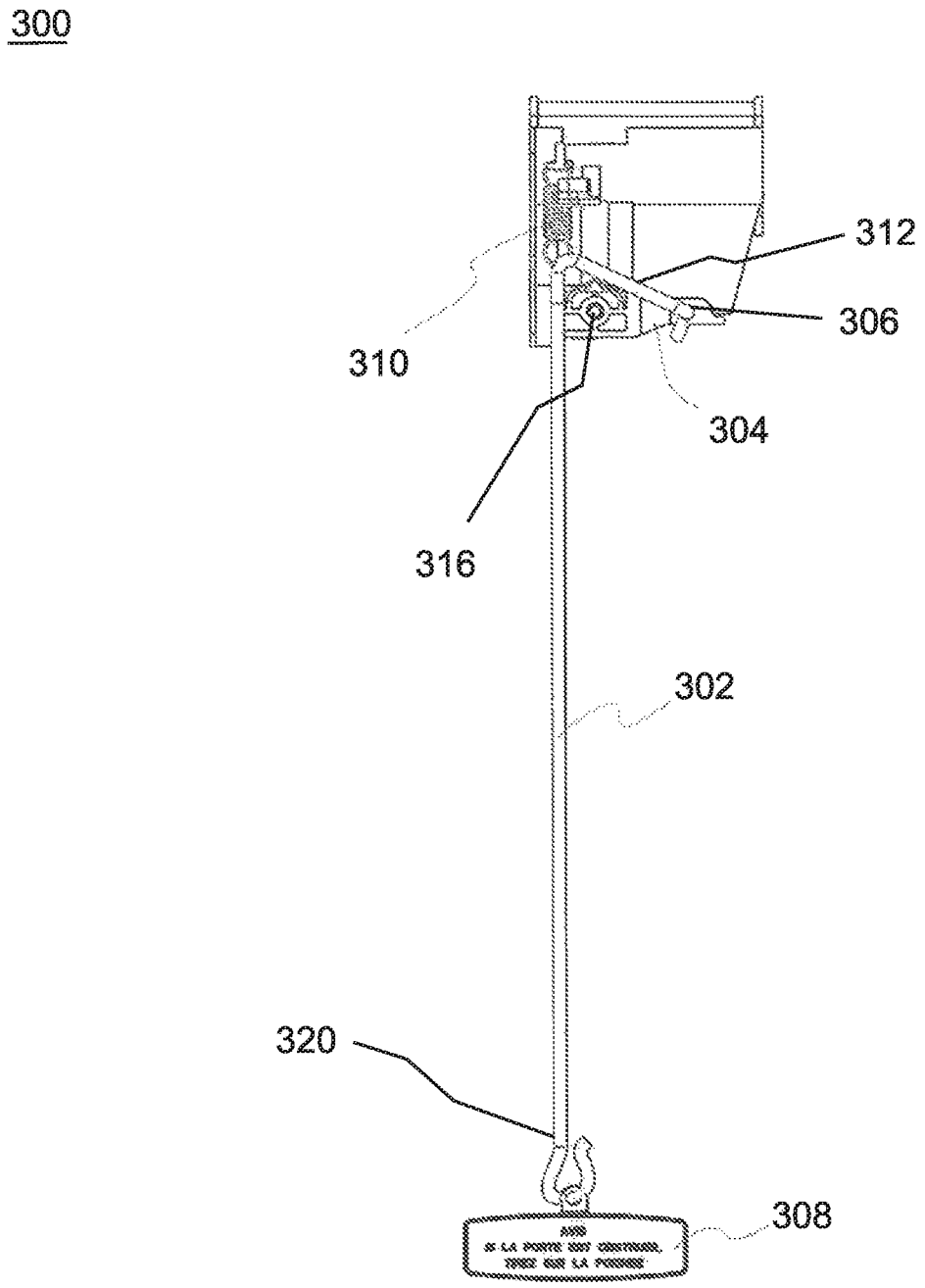
FIG. 3A shows in a side view the emergency release unit of FIG. 2A.

FIG. 3A shows an emergency release unit 300 that cannot be disengaged by directly pulling down the release cord 302 (labeled as release cord 214 in FIG. 2A). As can be seen in FIG. 3A, one end 306 of the release cord 302 is connected to the release handle 304 and the distal end of the cord 302 is connected to a manual release handle 308. A spring element 310 biases a section 312 of the release cord 302 at the handle end 306 of the cord upward so the section 312 rests at a position above a direction-reverse and protection shield, or direction reverser 314 (more clearly shown in FIG. 3B), which in turn is positioned above the pivot point axel 316, at which the release handle is pivotally mounted to the body 318 of the emergency release unit 300. Thus, the direction reverser 314 reverses the pulling direction of the cord at the handle end 306: pulling down the release cord 302 at the distal end 320 would cause the release handle 304 to pivot upward instead of downwards, which is the disengagement direction. In other words, pulling down the release cord directly would not disengage the emergency release plunger that is activated by the release handle 304, because its pulling direction at the end of the release handle is reversed to be up, not down.

Figure 3B:
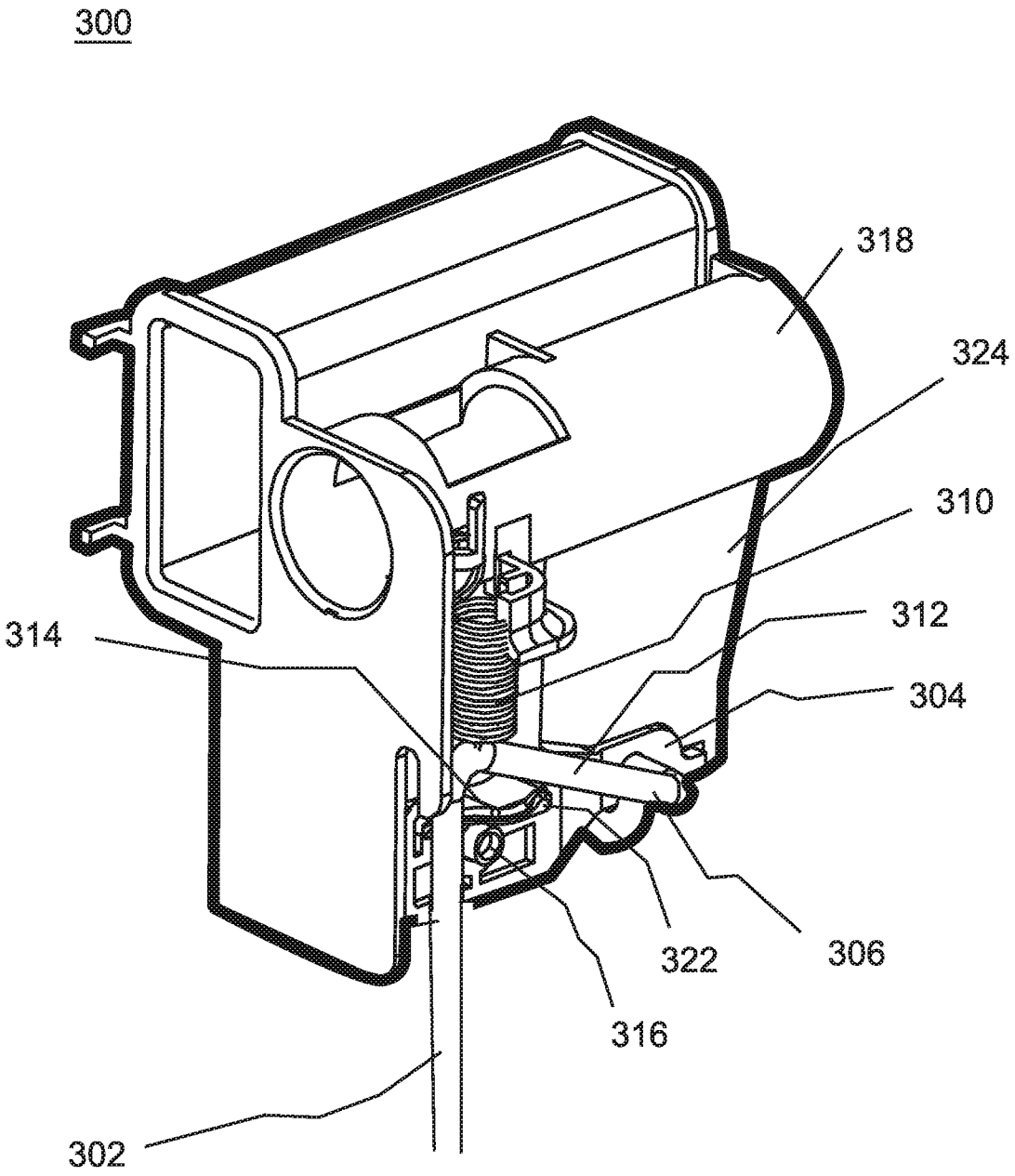
FIG. 3B is an enlarged view of the emergency release unit of FIG. 3A.

This arrangement is illustrated more clearly in an enlarged view in FIG. 3B. Release handle 304 is pivotally connected to the emergency release at pivot point 316. As the handle pivots downward, it pulls down the plunger 206 (not seen in FIG. 3B but see the cross-sectional view FIG. 2A) and out of the grove 212. Under normal operation condition, pivoting downward the release handle 304 disengages the emergency release. Spring element 310 holds a section of the emergency release cord 302 above the pivot point 316. Most unauthorized entry is usually done by pulling down the emergency release cord 302 with a hanger from the outside. However, according to this design, the cord 302 is positioned above the pivot point 316 of the handle and protected by a fin-shaped protector or direction reverser 314. The direction reverser 314 extends outwardly from the handle 304 and may curve upwards at its outer edge or terminating tip 322 as shown in FIG. 3B. This arrangement changes the pulling direction of the cord 302 at the handle end 306. The emergency release is designed to be disengaged by pivoting downwards the release handle 304 (i.e., in a clockwise direction as shown in FIG. 3B). With this design, pulling down the release cord 302 would pivot the release handle 304 upwards (i.e., in a counter-clockwise direction because of direction reverser 314), thus not to disengage the emergency release.

Figure 4A:
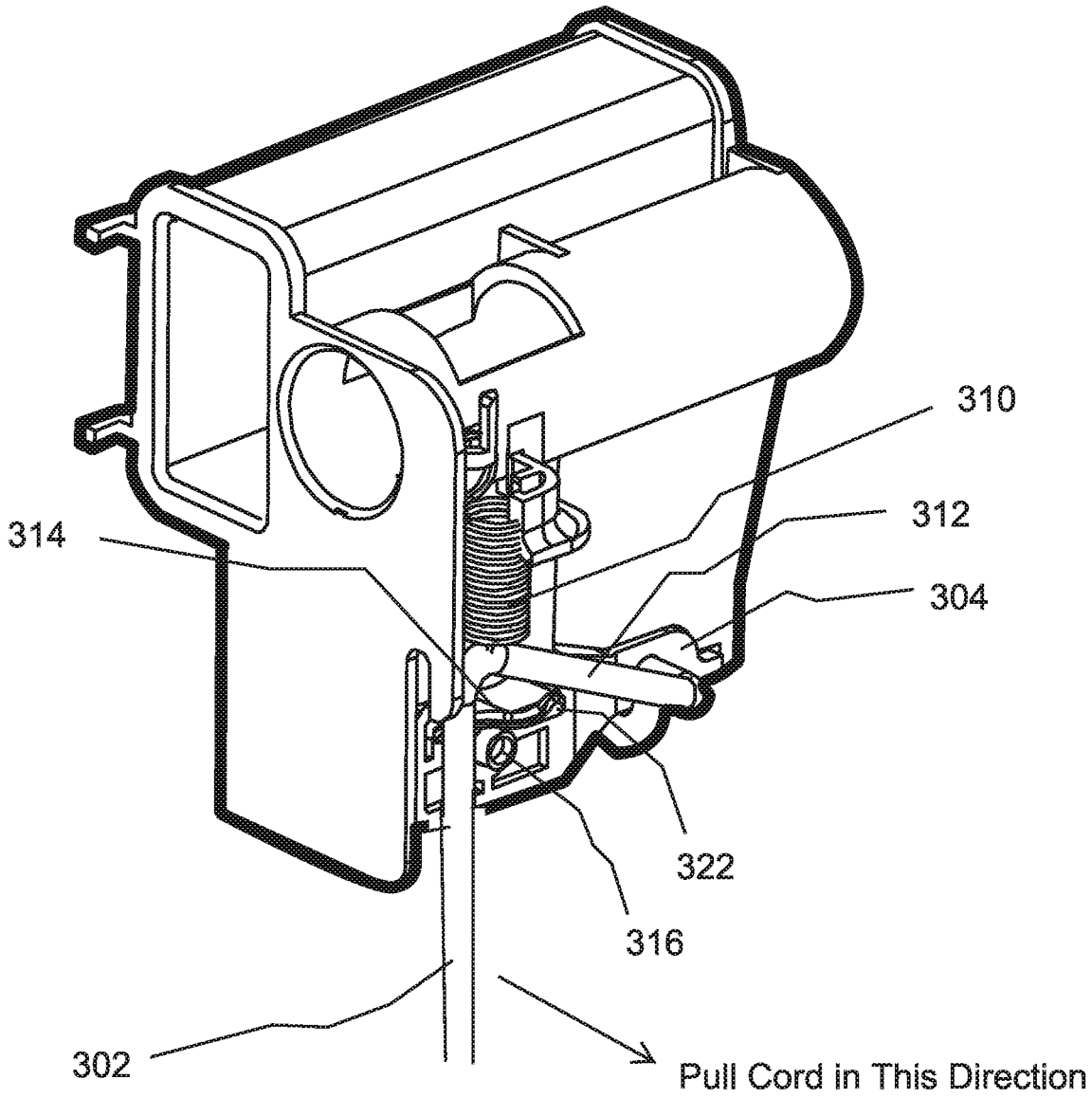
FIG. 4A illustrates an example of applying a sideway force to disengage the emergence release of FIG. 3A.

This design would not prevent an authorized user from disengaging the emergency release, if done from inside the garage. This is illustrated in FIG. 4A, which is almost the same as FIG. 3B, but with most reference numerals removed for clarity. Referring to FIG. 4A, in order to disengage the emergency release, it is now required to pull the cord 302, 214 in a slightly sideway direction against the biasing of the spring 310 in order to move the section 312 of the cord near the handle over the fin-shaped direction reverser 314 to bypass the direction reverser. Once the cord is pulled over the direction reverser 314, the pulling direction of the cord is no longer reversed by the reverser. As a result, the cord can be pulled downwards as usual to release the trolley 202 from the motor drive system 104.

Figure 4B:
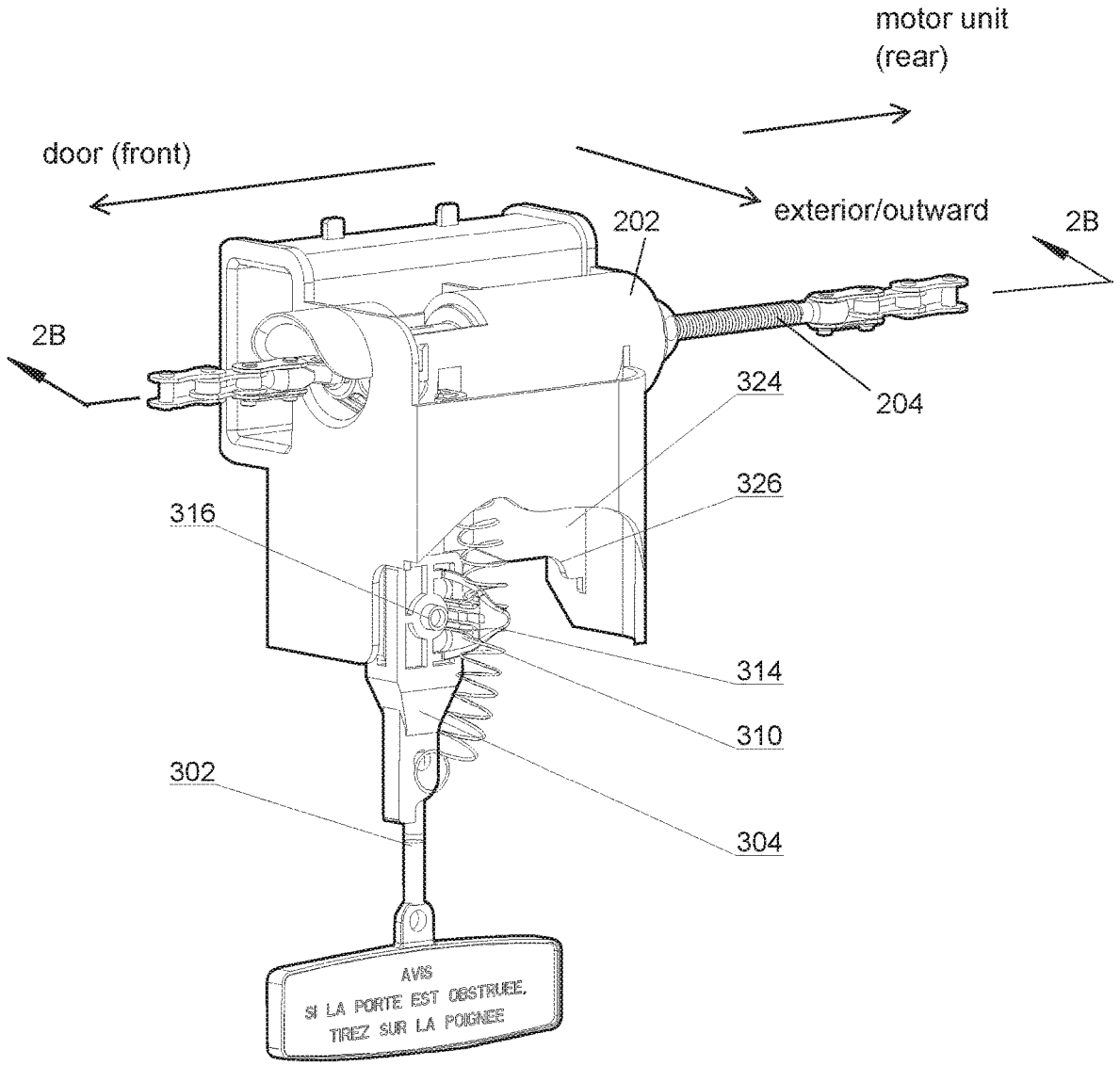
FIG. 4B illustrates in an perspective view the emergency release unit in a disengaged state.

FIG. 4B shows the spring element 310 and the release handle 304 when the emergency release is in a disengaged position. The release handle 304 is pivoted about 90° from an initial essentially horizontal position to a downward pointing vertical position, with the cord 302, 214 hanging down at its end. One end of the spring element 310 is always secured to a point above the pivot axel 316 or the fin-shaped direction reverser 314 even when the emergency release is in the disengaged state.

In FIG. 4A and FIG. 4B, the direction reverser 314 is shown formed integral with the release handle 304. As the release handle 304 is pulled down, the direction reverser 314 moves with the release handle. However, it will be appreciated that this direction reverser 314 also can be formed integral with the emergency release such as its body 318, or simply being attached to and extending from the body 318.

Additionally, although FIGS. 3B and 4A show a fin-shaped direction reverser, the direction reverser may take any form or shape (e.g., as a short post or peg, or even an irregularly shaped protuberance formed on the body or the release handle) as long as it can support a section 312 of the cord. Further, although the direction reverser is shown located above the pivot point, in general, what is required is that the direction reverser is placed at a location so that pulling the cord cannot pull down the release handle sufficiently so that it disengages the plunger. For example, if pivoting the release handle 304 a minimum rotation angle 60° will pull the plunger out of the grove, then the direction reverser is placed at a location so that it will prevent the cord from pulling down the release handle for more than an angle of 60°. Or, if pivoting the release handle 304 a minimum rotation angle 45° will pull the plunger out of the grove, then the direction reverser will need to be placed at a location a little higher so that it will prevent the cord from pulling down the release handle for more than an angle of 45°. This way, when the cord is grabbed by an unauthorized person from outside the garage, pulling down the cord directly will not move the release handle the required minimum amount of travel, whether a distance or rotation angle, thus unable to disengage the trolley from the motor drive system. In general, it is a minimum amount of travel, whether a travel distance or a rotation angle of the distal end of the release handle, that must be travelled before the plunger will be pulled out of the grove, i.e., to disengage the trolley from the motor drive system. The location of the direction reverser is such that, when the section 312 of the cord 302 is supported by the direction reverser 314, pulling the cord 302 will not be able to cause the distal end of the release handle 304 to move more than the required minimum amount of travel, whether a distance or rotation angle, thus unable to disengage the trolley.

Alternatively, this may be viewed as how the direction reverser 314 will change the direction of the pulling force. When the section 312 of the cord 302 is suspended around the direction reverser 314, pulling the cord 302 will not provide a pulling force component that is along the disengagement direction, i.e., the downward direction in this example, to move the distal end 306 of the release handle 304 along the disengagement direction. As no force will move the distal end 306 along the disengagement direction, the trolley 108 will not be disengaged from the motor drive system. Thus, the emergency release unit will remain to be in the engaged state and the power transmission arrangement will continue providing the driving force from the motor unit 102 to the door 112 to open or close the door. The driving force from the motor unit will not be separated from the door.

The fin-shaped protector, or direction reverser in particular, is to be sized sufficiently small to allow the cord to be pulled over it in a sideway direction so that the cord can bypass the protector and be pulled down directly to disengage the drive system from the door arm, if a person is to pull the cord and disengage the drive system inside the garage.

Figure 5:
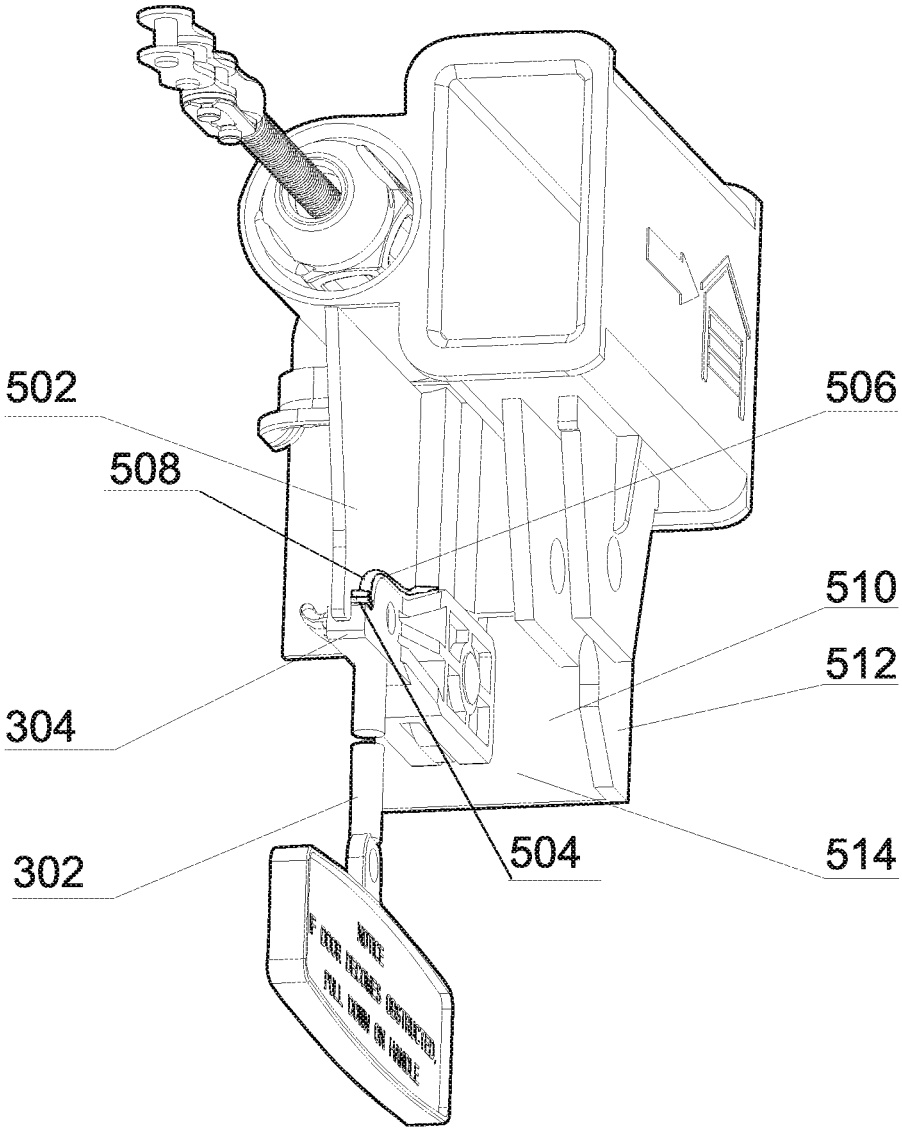
FIG. 5 is another perspective view of the emergency release unit of FIG. 3A showing additional protective wall and protective plate for preventing unauthorized access to the emergency release unit.

The release handle 304 is also protected from being accessed from sides and from above to reduce the likelihood of release handle being pushed or pulled down directly using a tool, such as a hanger, from outside the garage. A blocking shield in the nature of a blocking plate 324 protects the release handle from above (see FIG. 3B and FIG. 4B). FIG. 5 illustrates the use of protective walls, such as faceplates, and blocking plate for this purpose and their locations.

At its normal engaged position, a blocking shield in the nature of a blocking plate 324,502 is positioned right above the release handle 304. As a result, the release handle 304 is protected from above to deny unauthorized access. For improved protection, the bottom edge of the blocking plate and the upper edge of the release handle may have complementary shapes to favor tight contact therebetween, to prevent someone from inserting a thin object into a gap between the blocking plate and the release handle. For example, the blocking shield 324,502 may have a bottom edge 326,504 that has a shape profile complements the shape of the release handle 304 (or at least its upper edge portion 506) to favor tight contact. This thus denies access to, or at least makes it more difficult to gain access to, the release handle, in particular, its upper edge, for the purpose of pushing or pulling down the release handle, i.e., forcing it to move along the disengagement direction to disengage the emergency release. For further protection, the mounting position of the blocking plate 324,502 is such that its outward facing surface ("outward" being pointing away from the rail when the trolley is installed) is flush with the outer surface (or exterior surface) of the release handle. Alternatively, a flange 508 may be formed on and extending from each side (or one side) of the blocking plate 502. The flange 508 has a width (or the flanges and the blocking plate has a combined width) such that the upper edge 506 of the release handle 304 is more or less completely covered by the blocking plate 502 and the flanges 508. The flange 508 also may have the same shape profile of the bottom edge 504 of the blocking plate, i.e., to follow the shape of the upper edge 506 of the release handle.

Sidewalk or enclosure also can be used to protect the release lever 306 from being accessed in front and rear directions of the emergency release ("front" being a direction facing the door and "rear" being a direction facing away from the door) or from side directions. FIG. 5 shows a generally U-shaped protection wall 510 that includes two side faceplates 512 joined along their respective vertical edges by a front faceplate 514 to shield the release lever 304 from both front and side directions. The faceplates are sized sufficiently large so that they completely cover the release lever from both sides and the rear. It will be understood by those skilled in the art that the faceplates may not need to completely cover the release lever nor from all directions. In general, the purpose is to block access to the distal portion of the release lever 304. For example, covering only the distal portion may also effectively hinder unauthorized attempts to pull or push down the release handle at its distal end, using a tool from outside the garage. Such a shield would prevent having access from the outside with a hanger and pulling the handle down directly. Thus, although it may be less effective, only two side faceplates may be used and sized to cover only the distal portion of the release handle (or maybe only one plate to block access from the exterior side). For example, the protective wall may only need to protect one half, one third, one quarter, or even one fifth of the release handle at the distal end. On the other hand, although not shown in FIG. 5 for clarity, optionally, there can be an additional end plate joining the side faceplates to enclose the release handle from all four sides, to prevent access to the distal portion of the release lever also from rear, i.e., behind the emergency release. Finally, although FIG. 5 illustrates an example of mounting the protective wall or faceplates to the emergency release unit (or formed integral therewith), the protective wall or faceplates may be mounted to any other suitable structure such as the rail, or even garage door frame or the wall, so that when the door is closed, the protective wall can effectively shield the release handle.

Other embodiments are also possible. For example, in one particular embodiment, the garage door opener system includes a motor unit; a drive system coupled to and driven by the motor unit; a door arm to be connected to a garage door and, when engaged to and moved by the drive system, moving a garage door to open or close the door; and a secure emergency release unit, the secure emergency release unit connecting the drive system of the garage door opener system to the door arm to move the door. The secure emergency release unit has a body; a pair of cooperating engagement elements to releasably engage the door arm to the drive system; a release handle movably mounted to the body, the release handle having a distal end remote from the pivot point, wherein the release handle disengages the door arm when the distal end travels a minimum travel distance; and a protector for supporting a section of a release cord to be connected to the distal end of the release handle, wherein, the protector is positioned such that pulling the cord is unable to cause the distal end to travel the full minimum travel distance when the section is supported by the protector.

In another particular embodiment, the garage door opener system includes a motor unit; a drive system coupled to and driven by the motor unit; a door arm to be connected to a garage door and, when engaged to and moved by the drive system, moving a garage door to open or close the door; and a secure emergency release unit, the secure emergency release unit connecting the drive system of the garage door opener system to the door arm to move the door. The secure emergency release unit has a body; a pair of cooperating engagement elements to releasably engage the door arm to the drive system; a release handle movably mounted to the body, the release handle having a distal end remote from the pivot point, wherein the release handle disengages the door arm when the distal end travels a minimum travel distance; and a blocking plate mounted to the body and positioned above the release handle to prevent access to the distal portion of the release handle from above.

In yet another particular embodiment, a garage door opener system includes a motor unit; a drive system coupled to and drivers by the motor unit; a door arm to be connected to a garage door and, when engaged to and moved by the drive system, moving a garage door to open or close the door; and a secure emergency release unit, the secure emergency release unit connecting the drive system of the garage door opener system to the door arm to move the door. The secure emergency release unit has a body; a pair of cooperating engagement elements to releasably engage the door arm to the drive system; a release handle pivotally mounted to the body at a pivot point, the release handle having a distal end remote from the pivot point, wherein the release handle disengages the door arm when the release handle is pivoted a minimum rotation angle; a release cord to be connected to the distal end for pulling downwards at the distal end to pivot the release handle the minimum rotation angle to disengage the door arm from the drive system, downwards being a down-pointing direction when the garage door opener system is in an installed position; a direction reverser positioned above the pivot point; a biasing element secured to the body for suspending a section of the release cord above the direction reverser to reverse the pulling direction of the release cord; and a blocking plate mounted to the body and positioned above the release handle, the blocking plate having a lower edge that has a profile complementing that of an upper edge of the release handle, to prevent access to the distal portion of the release handle from above.

Various embodiments of the invention have now been described in detail. Those skilled in the art will appreciate that numerous modifications, adaptations and variations may be made to the embodiments without departing from the scope of the invention, which is defined by the appended claims. The scope of the claims should be given the broadest interpretation consistent with the description as a whole and not to be limited to these embodiments set forth in the examples or detailed description thereof.

What is claimed is:

1. A garage door opener system, comprising:

a motor unit providing a driving force for moving a garage door; and a power transmission arrangement for transmitting the driving force from the motor unit to the garage door, the power transmission arrangement including an emergency release unit, wherein when the emergency release unit is engaged, the power transmission mechanism transmits the driving force from the motor to the garage door and when the emergency release unit is disengaged, the driving force is separated from the garage door;

the emergency release unit comprising:

a body;

a release actuator mounted to the body, the release actuator having a distal end for fastening a release cord thereto, wherein the emergency release unit changes from engaged to disengaged when the distal end travels along a disengaging direction a minimum amount of travel;

a direction reverser positioned adjacent the distal end, the direction reverser supporting a section of the release cord around the direction reverser, wherein the direction reverser is positioned such that pulling the release cord suspended around the direction reverser does not move the distal end sufficiently along the disengagement direction to disengage the emergency release unit; and a biasing element secured to the body for suspending the section of the release cord around the direction reverser.

2. The garage door opener system of claim 1, wherein the emergency release unit further comprises a blocking shield mounted to the body to deny access to the release actuator for disengaging the emergency release.

3. The garage door opener system of claim 2, wherein the release actuator is a release handle movably mounted to the body, and moving the distal end downward disengages the emergency release unit, and wherein the release handle has an upper edge and the blocking shield has a bottom edge, the upper edge of the release handle and the bottom edge of the blocking shield having complementary shapes.

4. The garage door opener system of claim 3, wherein the blocking shield comprises a flange formed on and extending from a side of the blocking shield, to cover the upper edge of the release handle.

5. The garage door opener system of claim 1, wherein the direction reverser is integrally formed with and extending from the body of the emergency release unit.

6. The garage door opener system of claim 5, wherein the direction reverser is curved upwards towards a terminating tip of the direction reverser or an outer edge of the direction reverser.

7. The garage door opener system of claim 1, wherein the minimum amount of travel is one of a minimum travel distance and a minimum rotation angle.

8. The garage door opener system of claim 1, wherein the power transmission arrangement further comprises:

a drive system coupled to and driven by the motor unit;

a door arm to be connected to the garage door and, when engaged to and moved by the drive system, moving the garage door to open or close the garage door;

and wherein the emergency release unit further comprises:

a pair of cooperating engagement elements to releasably engage the door arm to the drive system.

9. The garage door opener system of claim 8, wherein the release actuator is a release handle movably mounted to the body, the release handle having a distal end remote from the pivot point, wherein the release handle disengages the door arm when the distal end travels a minimum travel distance.

10. The garage door opener system of claim 9, wherein the direction reverser is integrally formed with and extending from the release handle.

11. The garage door opener system of claim 10, wherein the direction reverser is curved upwards towards a terminating tip of the direction reverser or an outer edge of the direction reverser.

12. The garage door opener system of claim 9, wherein the release handle is pivotably mounted to the body at a pivot point and the direction reverser is positioned higher than the pivot point.

13. The garage door opener system of claim 12, wherein the direction reverser is above the pivot point.

14. The garage door opener system of claim 8, wherein the drive system has a trolley movable along a rail and connected to the door arm for transmitting the driving force from the motor unit to the garage door, the trolley having one of the pair of the cooperating engagement elements formed thereon, and the body of the emergency release unit having the other one of the pair of the cooperating engagement elements movably mounted thereon.

15. The garage door opener system of claim 14, wherein the engagement element formed on the trolley is a grove and the other one of the pair of the cooperating engagement elements mounted on the body is a plunger sized to fit within the grove.

16. The garage door opener system of claim 1, wherein the emergency release unit further comprises:

a protective wall that is sized to cover the distal end of the release actuator when the garage door is in a closed position.

17. The garage door opener system of claim 16, wherein the protective wall is sized to completely cover a fraction of the release handle near the distal end.

18. The garage door opener system of claim 17, wherein the fraction is one of one half, one third, one quarter, or one fifth.

19. The garage door opener system of claim 16, wherein the protective wall is mounted to the body of the emergency release unit.

20. The garage door opener system of claim 19, wherein the protective wall comprises:

a) two side faceplates, joined by a front and a rear faceplates, b) two side faceplates joined by a front faceplate; or c) two or one side faceplate.

* * * * *